US011577415B2

(12) United States Patent
Davignon et al.

(10) Patent No.: US 11,577,415 B2
(45) Date of Patent: Feb. 14, 2023

(54) HAIR CLIPPER WITH BLADE ANGLE ADJUSTMENT

(71) Applicant: WAHL CLIPPER CORPORATION, Sterling, IL (US)

(72) Inventors: Barry Davignon, Terre Haute, IN (US); Chad Aulwes, Sterling, IL (US)

(73) Assignee: WAHL CLIPPER CORPORATION, Sterling, IL (US)

( * ) Notice: Subject to any disclaimer, the term of this patent is extended or adjusted under 35 U.S.C. 154(b) by 13 days.

(21) Appl. No.: 17/205,368

(22) Filed: Mar. 18, 2021

(65) Prior Publication Data

US 2021/0291390 A1 Sep. 23, 2021

Related U.S. Application Data

(60) Provisional application No. 62/991,381, filed on Mar. 18, 2020.

(51) Int. Cl.
*B26B 19/06* (2006.01)
*B26B 19/38* (2006.01)
*B26B 19/04* (2006.01)

(52) U.S. Cl.
CPC ..... *B26B 19/063* (2013.01); *B26B 19/046* (2013.01); *B26B 19/3846* (2013.01)

(58) Field of Classification Search
CPC . B26B 19/063; B26B 19/048; B26B 19/3846; B26B 19/046
See application file for complete search history.

(56) References Cited

U.S. PATENT DOCUMENTS 567,583 A * 9/1896 Curtis ..... B26B 19/063 30/220
1,427,587 A * 8/1922 Fugitt ..... B26B 19/063 30/199
2,025,137 A * 12/1935 Wahl ..... B26B 19/06 30/201
3,280,456 A * 10/1966 Erickson ..... B26B 19/205 30/201
3,992,778 A * 11/1976 Urbush ..... B26B 19/06 30/220

(Continued)

OTHER PUBLICATIONS

International Search Report and Written Opinion received for PCT/US2021/022909, dated Jun. 8, 2021.

*Primary Examiner* — Evan H MacFarlane
*Assistant Examiner* — Fernando A Ayala
(74) *Attorney, Agent, or Firm* — Greer, Burns & Crain Ltd

(57) ABSTRACT

A hair clipper with blade angle adjustment is provided, including a clipper housing defining a longitudinal axis and a cutting end, a clipper bladeset operationally connected to the cutting end and including a stationary blade and a moving blade configured for reciprocating laterally relative to the stationary blade. A cam follower is connected to the bladeset and associated with the clipper housing for rotation about a rotation axis relative to the clipper housing, and a bladeset angle control is associated with the clipper housing. A power transmission is member associated with the clipper housing, connected to the cam follower and constructed and arranged so that user manipulation of the bladeset angle control causes linear movement of the power transmission member and associated angular movement of the bladeset through rotation of the cam follower.

17 Claims, 7 Drawing Sheets

(56) References Cited

U.S. PATENT DOCUMENTS

| | | | | |
|---|---|---|---|---|
| 4,249,307 | A * | 2/1981 | Andis | B26B 19/3846 30/223 |
| 5,325,589 | A * | 7/1994 | Kubo | B26B 19/205 30/201 |
| 5,579,581 | A | 12/1996 | Melton | |
| 5,606,799 | A | 3/1997 | Melton | |
| 5,970,616 | A * | 10/1999 | Wahl | B26B 19/063 30/216 |
| 6,502,312 | B2 * | 1/2003 | Beutel | B26B 19/063 30/216 |
| 8,677,627 | B2 | 3/2014 | Li et al. | |
| 2002/0000043 | A1 | 1/2002 | Beutel et al. | |
| 2003/0005585 | A1 * | 1/2003 | Rizzuto, Jr. | B26B 19/205 30/43.92 |
| 2007/0119059 | A1 | 5/2007 | Leventhal | |
| 2008/0155834 | A1 | 7/2008 | Li et al. | |
| 2008/0172885 | A1 | 7/2008 | Morisugi et al. | |
| 2008/0295340 | A1 * | 12/2008 | Carlucci | B26B 19/3853 30/199 |
| 2012/0084983 | A1 | 4/2012 | Moseman | |
| 2012/0297630 | A1 * | 11/2012 | Krause | B26B 19/24 30/329 |
| 2020/0055205 | A1 * | 2/2020 | Werner | B26B 19/06 |
| 2020/0215707 | A1 * | 7/2020 | Eijkelkamp | B26B 19/38 |
| 2021/0060804 | A1 * | 3/2021 | Tran | A61L 2/10 |

* cited by examiner

HAIR CLIPPER WITH BLADE ANGLE ADJUSTMENT

RELATED APPLICATION

The present application claims the benefit under 35 USC 119(e) of U.S. Provisional Application No. 62/991,381 filed Mar. 18, 2020, the entire contents of which are incorporated by reference herein.

BACKGROUND

The present invention relates generally to powered hair cutting appliances, namely hair clippers and hair trimmers, and more specifically to powered hair cutting appliances with bladesets that are pivotable relative to a clipper housing.

Powered hair cutting appliances, more specifically hair clippers and hair trimmers (here collectively referred to as "hair clippers") are well known in the art, for both cutting and styling hair, and also for trimming edges of a person's hairline to achieve a relatively sharply defined edge. Such devices are used by professional hair stylists and barbers, and also by consumers to trim ones' own hair, or the hair of others.

A common drawback of conventional hair clippers is that when cutting a person's hair to achieve fine edging or detailing, it becomes difficult for the stylist, whether or not a professional, to see the specific area of the scalp being worked on. One attempt to avoid this visibility problem is to configure a working end of the hair clipper so that the bladeset, including a fixed or stationary blade, and a moving blade reciprocating laterally relative to the stationary blade, is movable relative to a clipper housing of the clipper. Many variations of hair clippers with pivoting bladesets are known in the art.

However, known hair clippers are provided where the work area is obscured by the bladeset to the extent where the stylist has difficulty viewing the work area, making fine detail clipping difficult.

Thus, there is a need for an improved hair clipper in which the work area is easily visible to the stylist.

SUMMARY

The above-listed need is met or exceeded by the present hair clipper with a pivoting bladeset for enhanced user visibility. In the present clipper, the bladeset, including a stationary blade and a laterally reciprocating moving blade, is mounted on a cam follower associated with a clipper housing. The cam unit is rotatable under user control for providing a variety of angular positions for the bladeset relative to the clipper housing. Also, the cam follower accommodates a cam connected to a drive motor, and is configured for laterally reciprocating relative to the housing for causing the desired reciprocating movement of the moving blade relative to the stationary blade. In addition, the user control of the selected bladeset position is determined by user activation of a bladeset angle control on the clipper housing. Movement of the bladeset from the bladeset angle control is achieved through use of an elongate power transmission member. In the preferred embodiment, the power transmission member is an elongate, generally planar strap.

Mounted to an underside of the clipper housing, preferably an upper portion of the housing, the power transmission member is movable between first and second travel limits of the cam follower. Preferably, these limits are defined by ends of at least one elongated slot in the power transmission member, that each accommodate a corresponding retaining fastener secured to the upper portion of the housing. In addition, the power transmission member is secured to the bladeset angle control, and a free end of the power transmission member is secured to the bladeset, of which the moving blade is connected to the cam follower for common movement. Accordingly, axial movement of the power transmission member causes rotation of the cam follower about a rotation axis perpendicular to that of the clipper housing. In the preferred embodiment, the movement of the power transmission member is reciprocal relative to the clipper housing.

It is preferred that the power transmission member is constructed and arranged for providing at least one, and preferably a plurality of indexed angular positions to the bladeset. Preferably, the indexing is achieved through use of a plurality of complementary lugs and openings that determine the position of the power transmission member relative to the clipper housing. In a rest or operational position, the lugs are engaged in corresponding openings, to lock the bladeset in a selected angular orientation relative to the clipper housing. When the user desires to change the angular orientation of the bladeset, the bladeset angle control is depressed by the user, thus depressing the power transmission member so that the holes are disengaged from the lugs. Next, the bladeset angular control is manipulated by the user, so that the power transmission member is moved in the desired axial direction to achieve the next desired bladeset angular orientation. Once the position is achieved, the user releases the previously applied depressing force, allowing the power transmission member to reengage with the appropriate lugs on the housing member, thus securing the bladeset in the desired angular orientation.

More specifically, a hair clipper with blade angle adjustment is provided, including a clipper housing defining a longitudinal axis and a cutting end, a clipper bladeset operationally connected to the cutting end and including a stationary blade and a moving blade configured for reciprocating laterally relative to the stationary blade. A cam follower is connected to the bladeset and associated with the clipper housing for rotation about a rotation axis relative to the clipper housing, and a bladeset angle control is associated with the clipper housing. A power transmission is member associated with the clipper housing, connected to the cam follower and is constructed and arranged so that user manipulation of the bladeset angle control causes linear movement of the power transmission member and associated angular movement of the bladeset through rotation of the cam follower.

In an embodiment, the rotation axis is transverse to the longitudinal axis. Also, the clipper further includes a drive system including an offset cam operationally connected to said cam follower for causing reciprocating movement of said moving blade relative to said stationary blade. In an embodiment, the cam follower is movable along the rotation axis relative to the clipper housing in conjunction with the reciprocating movement of the moving blade. Preferably, the bladeset angle control is associated with an upper portion of the clipper housing, and is movable along the longitudinal axis as well as transverse to the axis.

In an embodiment, the power transmission member is connected at a free end to the bladeset, and is slidably mounted to the clipper housing for movement along the longitudinal axis. Also preferably, the power transmission member has elongate slots that define a travel distance of the bladeset from a first position to a second position. Further, the power transmission member has a plurality of indexed positions disposed along the longitudinal axis, the indexed positions are defined by engagement of the power transmission member to the clipper housing preferably using a plurality of linearly spaced lugs and openings. In an embodiment, the lugs depend from an underside of an upper portion of the clipper housing, and the openings are located on the power transmission member.

In an embodiment the bladeset angle control is associated with an upper portion of the clipper housing, is movable along the longitudinal axis as well as transverse to the axis and is connected to the power transmission member for common movement, so that linear movement of the bladeset angle control causes movement of the power transmission member. Also, movement of the bladeset angle control transverse to the clipper housing causes disengagement of the openings from the lugs, unlocking the selected angular position of the bladeset.

In a preferred embodiment, movement of the power transmission member is reciprocal relative to the clipper housing, and the power transmission member is an elongate, generally planar strap.

In another embodiment, a hair clipper with blade angle adjustment is provided, including a clipper housing defining a longitudinal axis, a cutting end and an upper housing portion, a clipper bladeset operationally connected to the cutting end and including a stationary blade and a moving blade configured for reciprocating laterally relative to the stationary blade. A cam follower is connected to the bladeset and is associated with the clipper housing for rotation about a rotation axis relative to the clipper housing. A bladeset angle control is associated with the upper portion of the clipper housing. A power transmission member is associated with the clipper housing, is connected to the cam follower and is constructed and arranged so that user manipulation of the bladeset angle control causes linear movement of the power transmission member and associated angular movement of the bladeset through rotation of the cam follower.

The power transmission member is releasably lockable relative to the upper portion of the clipper housing using a plurality of complementary lugs and openings, such that engagement of the lugs in the openings prevents longitudinal movement of the power transmission member. The bladeset angle control is movable along the longitudinal axis as well as transverse to the axis and is connected to the power transmission member for common movement, so that linear movement of the bladeset angle control causes movement of the power transmission member, and movement of the bladeset angle control transverse to the clipper housing causes disengagement of the openings from the lugs, unlocking the selected angular position of the bladeset.

DETAILED DESCRIPTION

Figure 1:
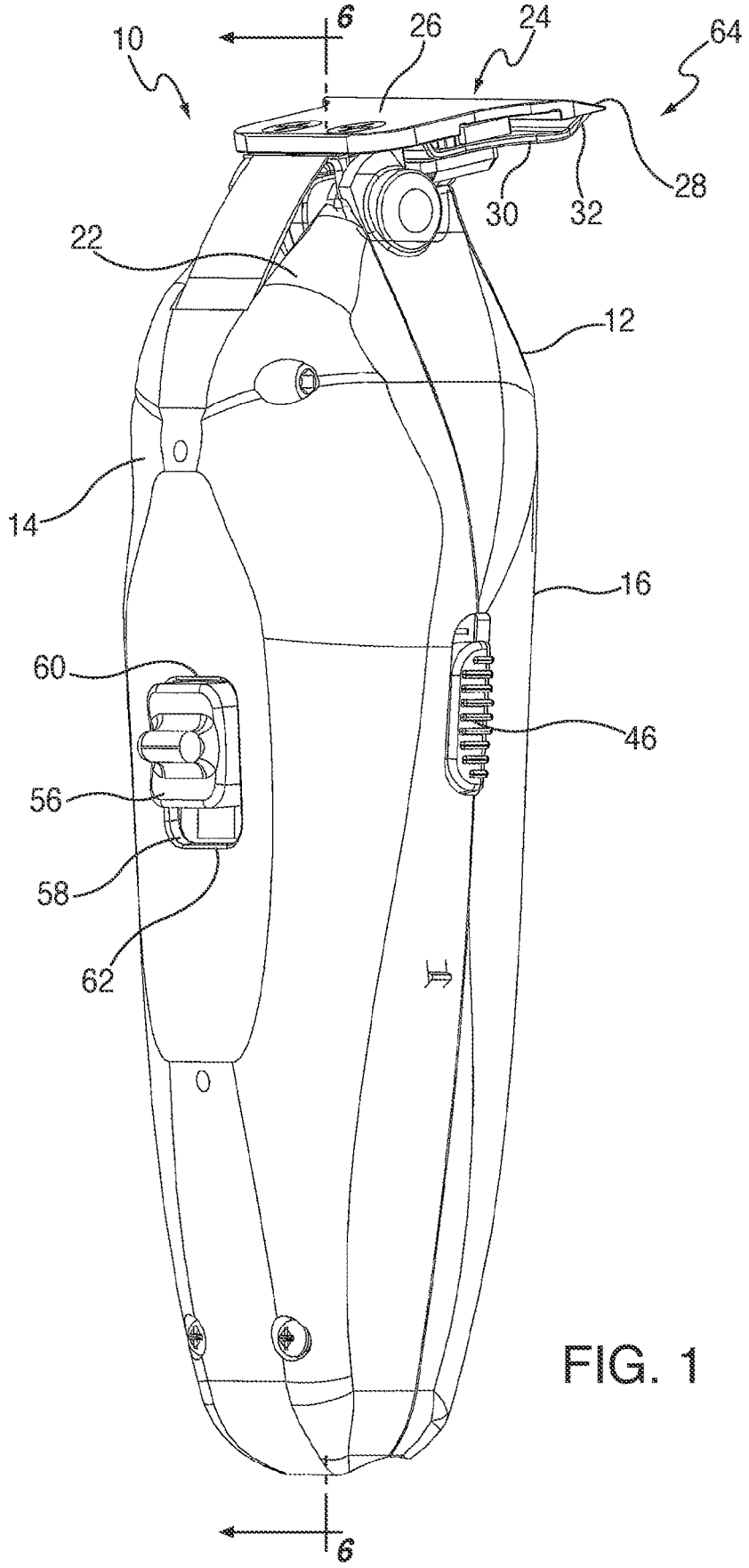
FIG. 1 is a side perspective of the present hair clipper in a first bladeset position.
Figure 2:
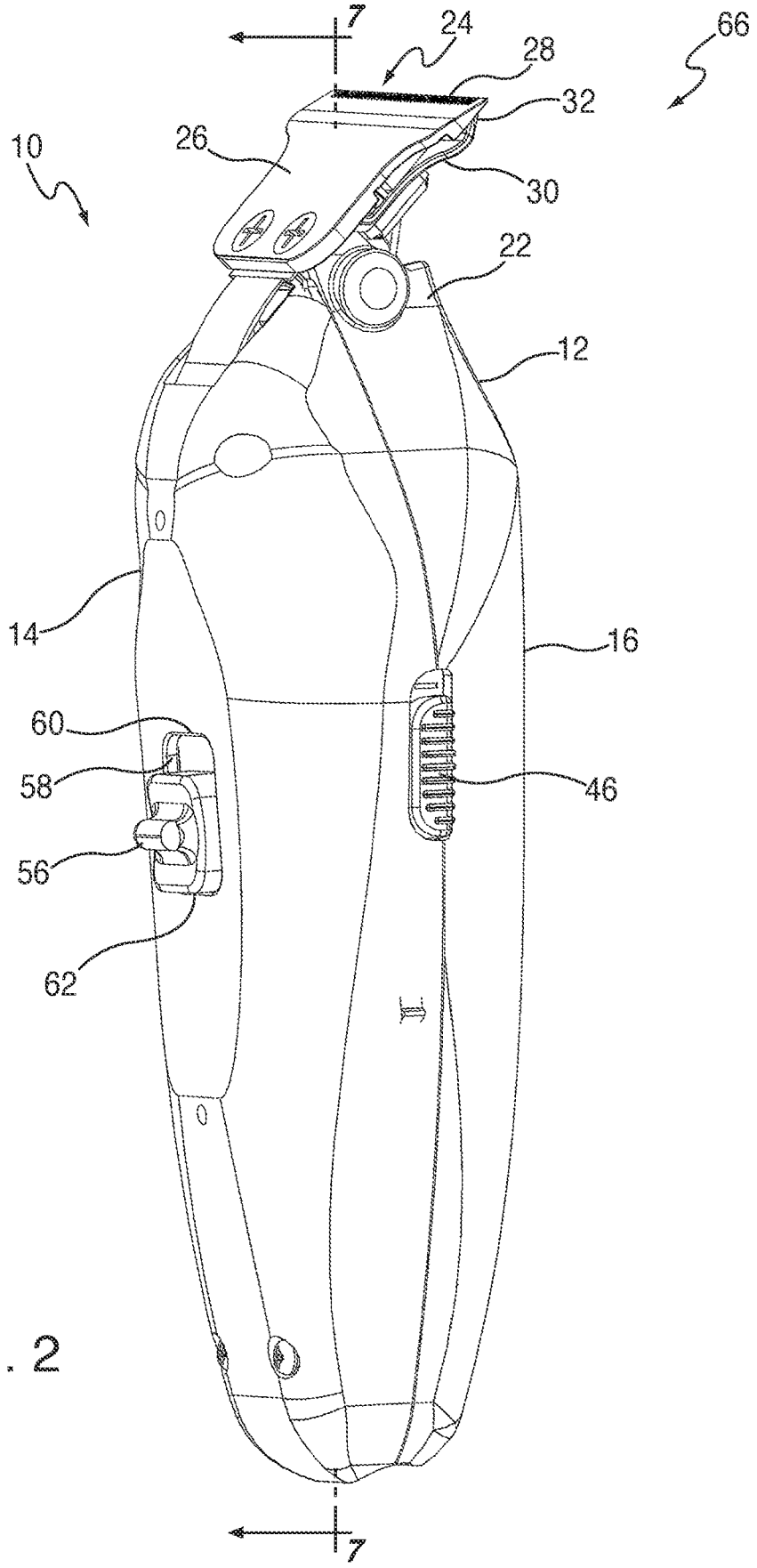
FIG. 2 is a side perspective view of the present hair clipper in a second bladeset position.
Figure 3:
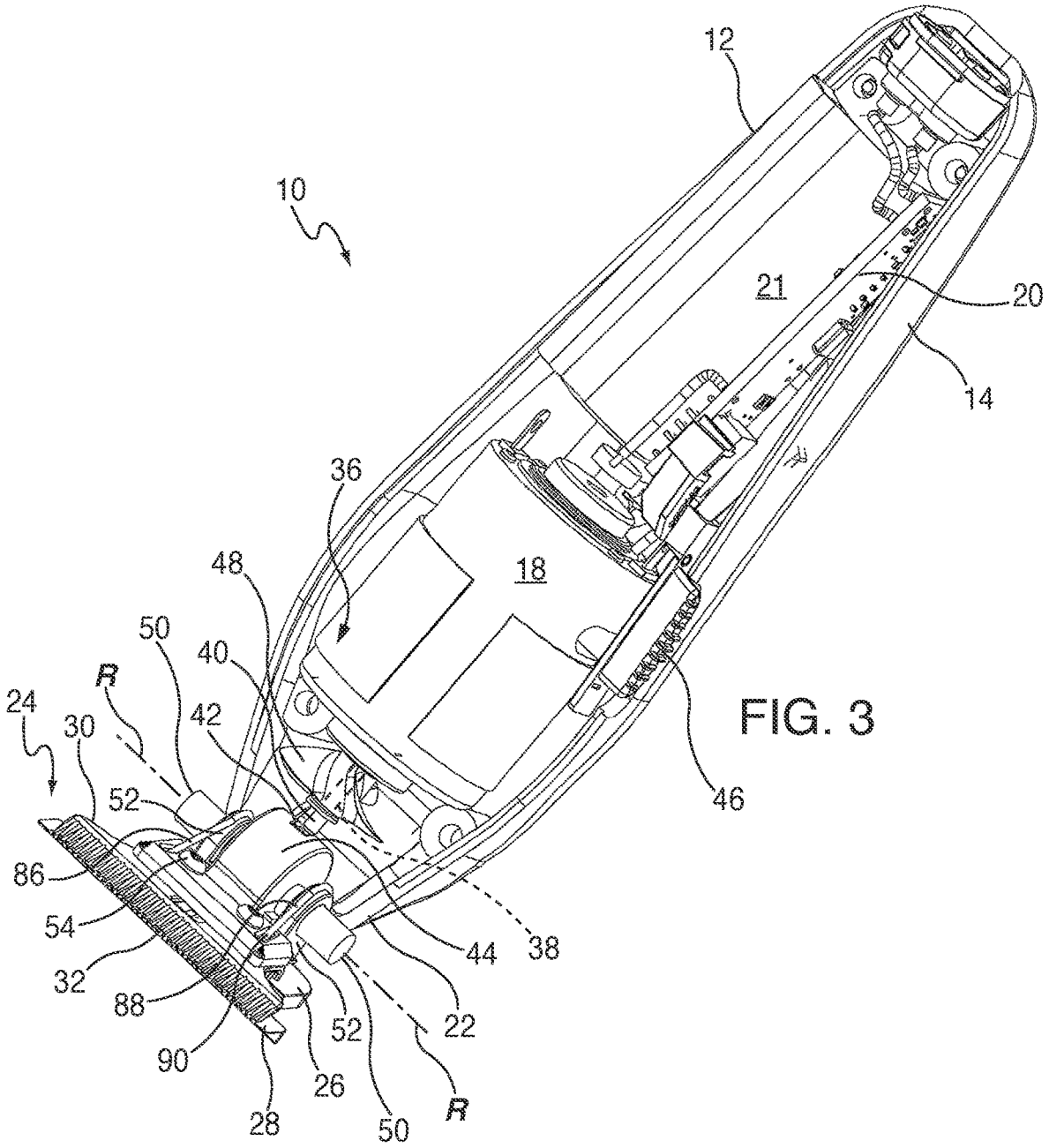
FIG. 3 is a bottom perspective view of the present hair clipper with portions removed for increased visibility.

Referring now to FIGS. 1-3, the present hair clipper is generally designated 10, and includes a clipper housing 12 which is preferably provided in two, clamshell-like housing portions, and upper portion 14 and a lower portion 16. While in the present application, attention is drawn to the upper portion 14, it will be understood that the discussion also applies to the lower portion 16. The clipper housing 12 encloses, among other things a drive motor 18 (FIG. 3), electronic circuitry 20, an optional rechargeable battery 21 which are well known to those of ordinary skill in the art. The housing 12 defines a longitudinal axis "L" (FIG. 5) and has a cutting end 22.

Included on the hair clipper 10 is a clipper bladeset 24, operationally connected to the cutting end 22 and made up of a stationary blade 26 with a plurality of stationary blade teeth 28, and an opposing moving blade 30 having a plurality of moving blade teeth 32. A cutting line 34 (FIG. 4) is formed by the engagement of the teeth 28, 32 as the moving blade 30 is reciprocated laterally relative to the stationary blade 26.

Figure 4:
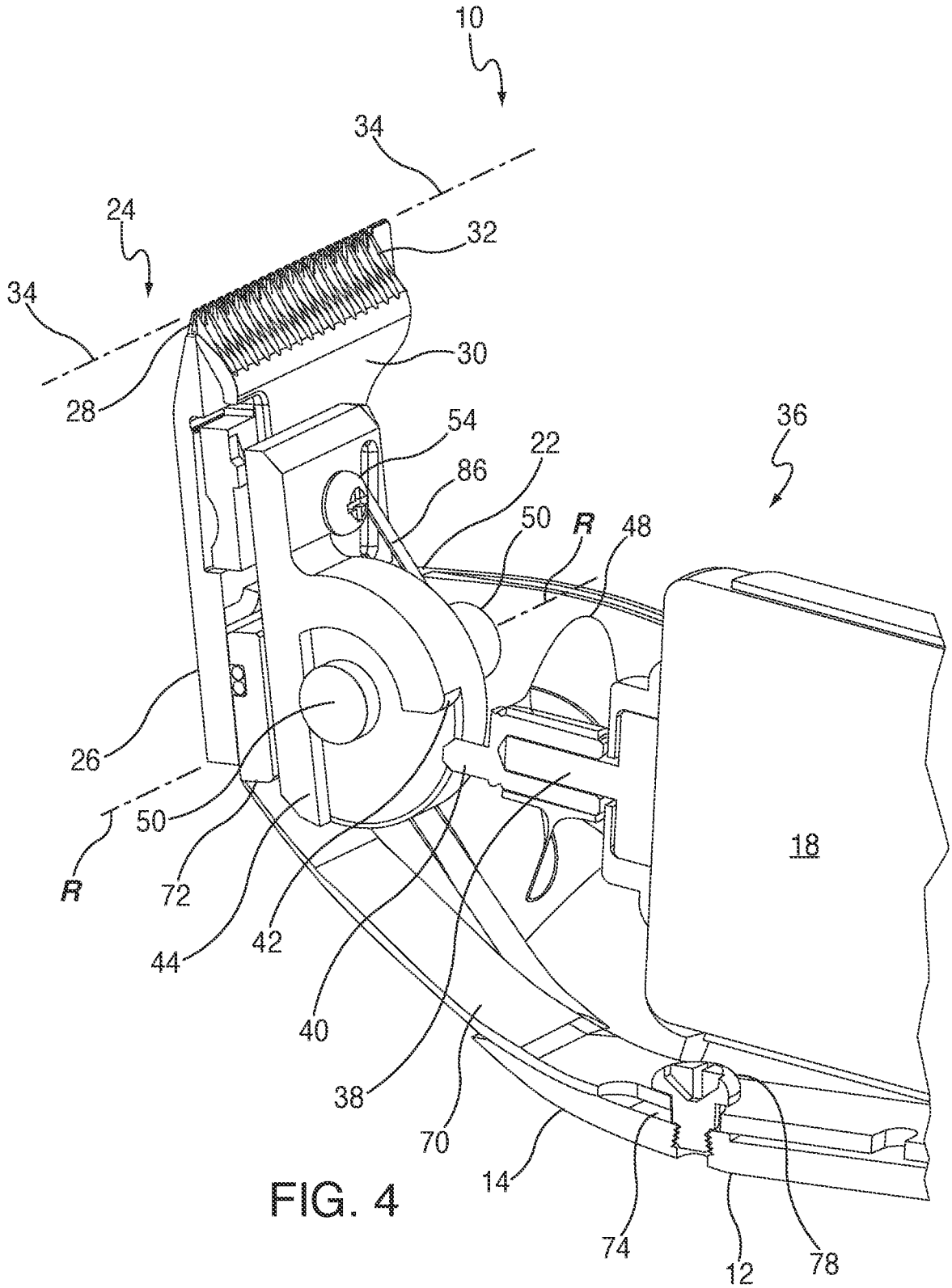
FIG. 4 is an enlarged fragmentary side perspective view of the clipper of FIG. 3.

Referring now to FIGS. 3 and 4, also included on the hair clipper 10 is a drive system 36, including the drive motor 18 having a motor driveshaft 38 which is connected to an eccentric cam pin 40 so that the rotary motion of the driveshaft is converted to linear motion, as is well known in the art. A drive slot 42 in a cam follower 44 receives the cam pin 40. Attachment of the cam follower 44 to the moving blade 30 causes the moving blade to reciprocate laterally relative to the stationary blade 26 for creating cutting action, as is well known in the art. An on/off switch 46 is located on the clipper housing 12 and is connected to the circuitry 20 for controlling the drive motor 18. In the preferred embodiment, a fan 48, also preferably part of the cam pin 40, is fastened to the motor driveshaft 38 for enhancing ventilation within the housing 12 during clipper operation.

Included on the cam follower 44 is a pair of projecting stub shafts 50 which define a rotation axis "R" that is transverse to the longitudinal axis "L" of the clipper housing 12. The stub shafts 50 are loosely engaged in a bracket 52 preferably integral with the clipper housing 12 so that the cam follower 44 is pivotably engaged in the housing. As seen in FIGS. 3 and 4, the cam follower 44 is attached to the moving blade 30 by threaded fasteners 54 or the like engaging a blade guide 55 (FIG. 4) so that the two components move together. As the motor drive shaft 38 rotates, the cam pin 40 engages the drive slot 42, causing lateral reciprocal movement of both the cam follower 44 and the moving blade 30. A feature of the present clipper 10 is that the cam follower 44 also rotates about the rotation axis "R" relative to the clipper housing 12. Since the moving blade 30 is secured to the cam follower 44, the moving blade, as well as the stationary blade 26 also rotate about the rotation axis "R".

As seen in FIGS. 1 and 2, the present hair clipper 10 also includes a bladeset angle control 56 positioned in a control aperture 58 in the clipper housing 12, and the control is preferably associated with in the upper housing portion 14, the aperture dimensioned such that the bladeset angle control is movable along the longitudinal axis "L" between a first end 60 closer to the bladeset 24, and an opposite second end 62. As seen in FIGS. 1 and 2, the first end 60 is associated with a first bladeset position 64, and the second end 62 is associated with a second bladeset position 66. While other angles are contemplated, depending on the application, the first bladeset position 64 defines an angle approximately 90 degrees relative to the longitudinal axis "L", and the second bladeset position 66 defines an angle approximately 45 degrees relative to the longitudinal axis "L".

Figure 5:
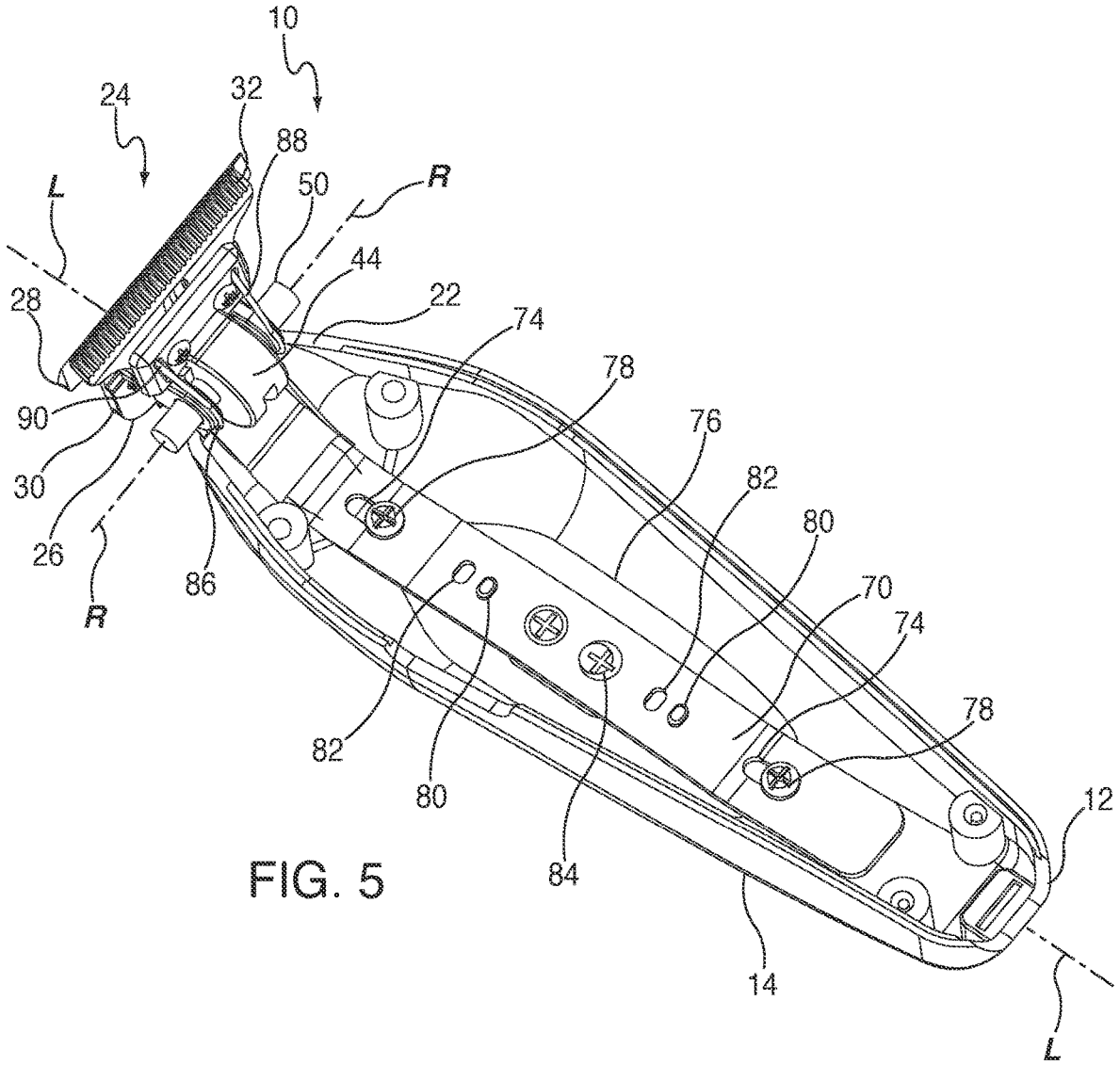
FIG. 5 is another bottom perspective view of the present hair clipper with additional portions removed compared to FIG. 3 for enhanced visibility of the present power transmission member and bladeset orientation structure.

Referring now to FIGS. 4 and 5, a power transmission member is generally designated 70 and is associated with the clipper housing 12, is connected to the cam follower 44 and is constructed and arranged so that user manipulation of the bladeset angle control 56 causes linear movement of the power transmission member and associated angular movement of 24 bladeset through rotation of the cam follower about the rotation axis "R". Thus, the movement of the power transmission member 70 is reciprocal relative to the clipper housing 12. Also, in the preferred embodiment, the power transmission member 70 is an elongate, generally planar strap, made of a flexible, self-supporting material such as stiff plastic, metal or the like.

Preferably, a free end 72 of the power transmission member 70 is connected to the bladeset 24, such as being fastened to the stationary blade 26 (FIG. 4). As is well known in the hair clipper art, the moving blade 30 is movably secured to the stationary blade 26 to maintain the blades in close, sliding relationship to each other. Thus, under the user control using the bladeset angle control 56, as the user manipulates the control in the aperture 58 and moves the power transmission member 70 longitudinally relative to the clipper housing 12, the bladeset 24 is rotated about the rotation axis "R."

More specifically, and referring now to FIG. 5, the power transmission member 70 has at least one and preferably a pair of elongate slots 74 that define a travel distance of the bladeset 24 from the first bladeset position 64 to the second bladeset position 66. While other dimensions are contemplated, the travel distance of the slots 74 preferably corresponds to the travel distance of the bladeset angle control 56 in the control aperture 58. Slidable connection of the power transmission member 70 to an underside 76 of the upper housing portion 14 is achieved using preferably threaded fasteners 78 or the like. Once installed, the power transmission member 70 is closely and slidably engaged to the underside 76.

Another feature of the present clipper 10 is that the power transmission member 70 has a plurality of indexed positions disposed along the longitudinal axis "L", which result in a plurality of releasably locked angular orientations for the bladeset 24 relative to the clipper housing 12. In the preferred embodiment, the indexed positions are defined by engagement of the power transmission member 70 to the clipper housing 12, specifically the underside 76, using a plurality of complementary and linearly spaced lugs 80 and openings 82.

While a reverse orientation is contemplated, in the preferred embodiment, the lugs 80 depend from the underside 76 of the upper portion 14 of the clipper housing 12, and the openings 82 are located on the power transmission member 70. For preferred operation, the openings 82 are linearly spaced on the power transmission member 70 along the longitudinal axis "L", and are located closely adjacent the bladeset angle control 56. The number of lugs 80 and openings 82 may vary to suit the application, and relate directly to the number of potential releasably lockable, angular adjustment positions of the bladeset 24.

Figure 6:
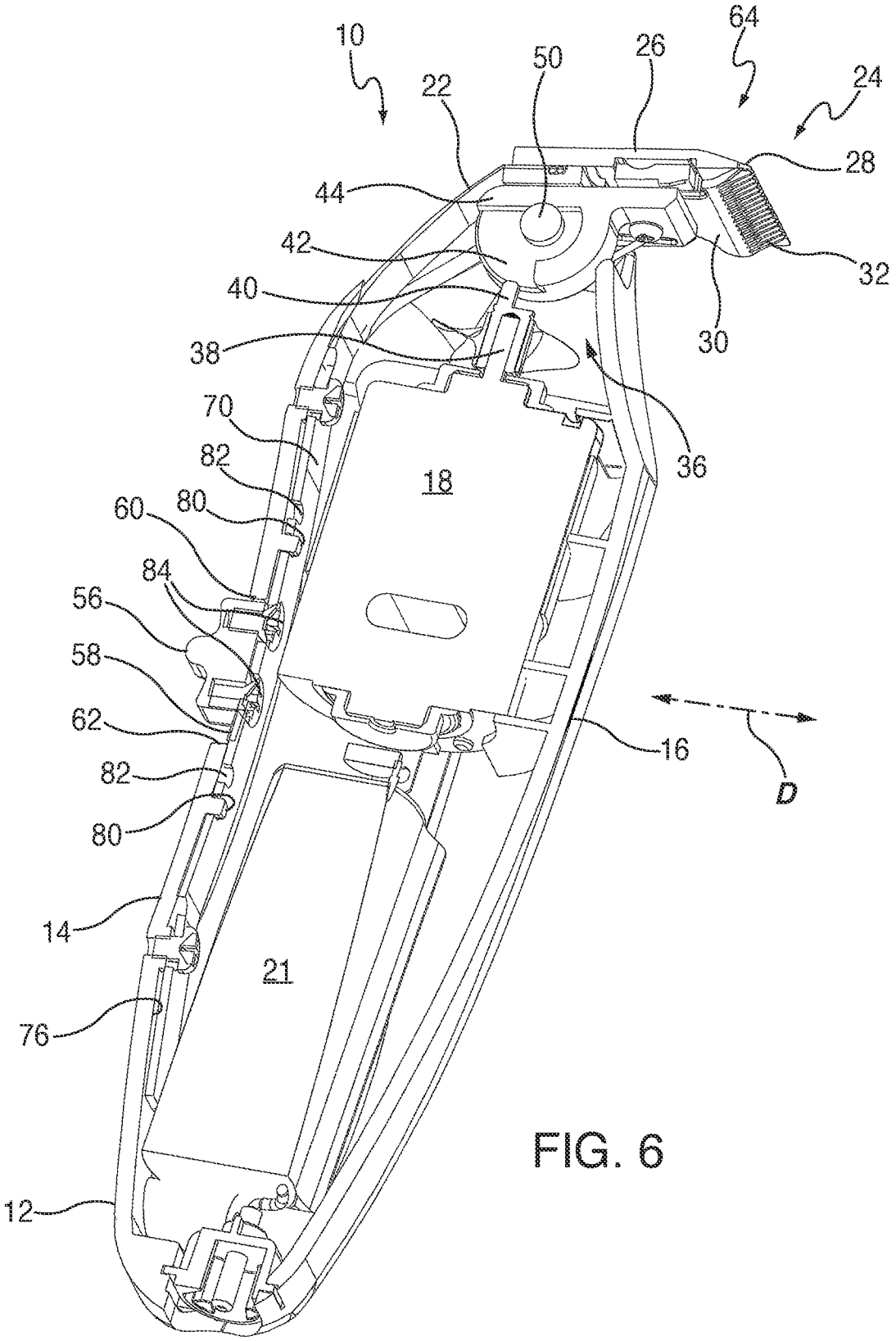
FIG. 6 is a vertical cross-section taken along the lines 6-6 of FIG. 1 and in the direction indicated generally.
Figure 7:
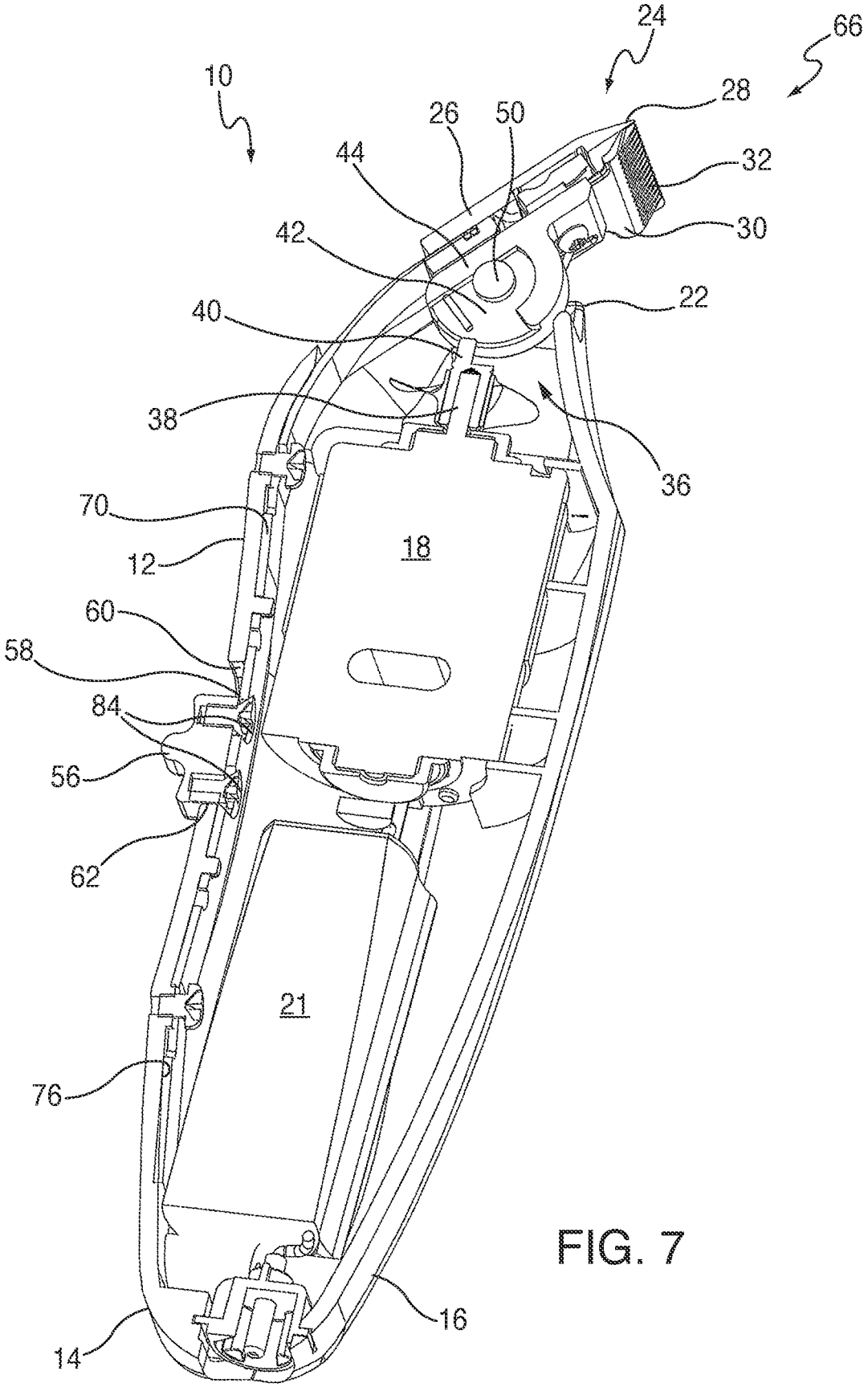
FIG. 7 is a vertical cross-section taken along the lines 7-7 of FIG. 2 and in the direction indicated generally.

Referring now to FIGS. 5-7, the power transmission member 70 is fastened to the bladeset angle control 56 using at least one, and preferably a pair of fasteners 84, which are preferably screws or the like. Thus, the bladeset angle control 56 and the power transmission member 70 move in unison. In addition to the linear, axial movement described above, the bladeset angle control 56 is also movable transverse to the longitudinal axis "L" in a direction "D" (FIG. 6) towards and away from the drive motor 18. An inherent biasing force created by the power transmission member 70 biases the bladeset angle control 56 away from the drive motor 18.

Thus, user-directed movement of the bladeset angle control 56 transverse to the clipper housing longitudinal axis via a pressing action temporarily overcomes this biasing force and causes disengagement of the openings 82 from the lugs 80, unlocking the power transmission member 70 and permitting slidable longitudinal movement between the first bladeset position 64 and the second bladeset angular position 66.

After the disengagement of the power transmission member, the user moves the bladeset angle control 56 until the openings 82 engage a next or desired lug 80, moving the bladeset 24 to a new angular position relative to the clipper housing 12. Once the bladeset angle control 56 is released by the user, the inherent biasing force generated by the power transmission member 70 secures the engagement of the selected lugs 80 and openings 82 to maintain the selected operational position of the bladeset 24. Once the lugs and the openings 80, 82 are properly engaged, the power transmission member 70 is prevented from linear sliding action relative to the clipper housing 12.

Referring now to FIGS. 3 and 5, another feature of the present bladeset 24 is that a spring 86, typically used to exert a biasing force pressing the moving blade 30 against the stationary blade 26 during the lateral reciprocation of the moving blade, is configured for accommodating the rotation of the bladeset about the rotation axis "R". As such, the spring 86 is provided with at least one, and preferably a pair of loop arms 88 that extend around the bracket 52 and the stub shafts 50, and free ends 90 of the arms are received in the cam follower 44 that presses against the moving blade 30.

While a particular embodiment of the present hair clipper with blade angle adjustment has been described herein, it will be appreciated by those skilled in the art that changes and modifications may be made thereto without departing from the invention in its broader aspects and as set forth in the following claims.

The invention claimed is:

1. A hair clipper with blade angle adjustment, comprising:

a clipper housing defining a longitudinal axis and a cutting end;

a clipper bladeset operationally connected to said cutting end and including a stationary blade and a moving blade, the moving blade configured for reciprocating laterally relative to said stationary blade;

a cam follower connected to said bladeset and associated with said clipper housing for rotation about a rotation axis relative to said clipper housing;

a drive motor disposed within said clipper housing and connected to said cam follower for moving said moving blade relative to said stationary blade;

a bladeset angle control associated with said clipper housing;

a power transmission member associated with said clipper housing, connected to said cam follower and constructed and arranged so that user manipulation of said bladeset angle control causes linear movement of said power transmission member and associated angular movement of said bladeset through rotation of said cam follower; and said power transmission member defines a plurality of pre-defined indexed positions which correspondingly define a plurality of discrete releasably locked orientations of the bladeset.

2. The hair clipper of claim 1, wherein said rotation axis is transverse to said longitudinal axis.

3. The hair clipper of claim 1, further including a drive system including an offset cam operationally connected to said cam follower for causing reciprocating movement of said moving blade relative to said stationary blade.

4. The hair clipper of claim 1, wherein said cam follower is movable along said rotation axis relative to said clipper housing in conjunction with said reciprocating movement of said moving blade.

5. The hair clipper of claim 1, wherein said bladeset angle control is associated with an upper portion of said clipper housing, and is movable along said longitudinal axis as well as transverse to said axis.

6. The hair clipper of claim 1 wherein said power transmission member is connected at a free end to said bladeset, and is slidably mounted to said clipper housing for movement along said longitudinal axis.

7. The hair clipper of claim 6, wherein said power transmission member has elongate slots that define a travel distance of said bladeset from a first position to a second position.

8. The hair clipper of claim 1, wherein said indexed positions are defined by engagement of said power transmission member to said clipper housing using a plurality of linearly spaced lugs and openings.

9. The hair clipper of claim 8, wherein said lugs depend from an underside of an upper portion of said clipper housing, and said openings are located on said power transmission member.

10. The hair clipper of claim 9, wherein said bladeset angle control is associated with an upper portion of said clipper housing, is movable along said longitudinal axis as well as transverse to said axis and is connected to said power transmission member for common movement, so that linear movement of said bladeset angle control causes movement of said power transmission member, and movement of said bladeset angle control transverse to said clipper housing causes disengagement of said openings from said lugs, unlocking the selected angular position of said bladeset.

11. The hair clipper of claim 1, wherein movement of said power transmission member is reciprocal relative to said clipper housing.

12. The hair clipper of claim 1, wherein said power transmission member is an elongate, generally planar strap.

13. A hair clipper with blade angle adjustment, comprising:

a clipper housing defining a longitudinal axis, a cutting end and an upper housing portion;

a clipper bladeset operationally connected to said cutting end and including a stationary blade and a moving blade, the moving blade configured for reciprocating laterally relative to said stationary blade;

a cam follower connected to said bladeset and associated with said clipper housing for rotation about a rotation axis relative to said clipper housing;

a bladeset angle control associated with said upper portion of said clipper housing;

a power transmission member associated with said clipper housing, connected to said cam follower and constructed and arranged so that user manipulation of said bladeset angle control causes linear movement of said power transmission member and associated angular movement of said bladeset through rotation of said cam follower;

said power transmission member being releasably lockable relative to said upper portion of said clipper housing using a plurality of complementary lugs and openings, such that engagement of said lugs in said openings prevents longitudinal movement of said power transmission member; and said bladeset angle control is movable along said longitudinal axis as well as transverse to said longitudinal axis and is connected to said power transmission member for common movement of the power transmission member and the bladeset angle control, so that linear movement of said bladeset angle control causes linear movement of said power transmission member, and movement of said bladeset angle control transverse to said clipper housing causes disengagement of said openings from said lugs, unlocking the selected angular position of said bladeset.

14. A hair clipper with blade angle adjustment, comprising:

a clipper housing defining a longitudinal axis and a cutting end;

a clipper bladeset operationally connected to said cutting end and including a stationary blade and a moving blade, the moving blade configured for reciprocating laterally relative to said stationary blade;

a cam follower connected to said bladeset and associated with said clipper housing for rotation about a rotation axis relative to said clipper housing;

a bladeset angle control associated with said clipper housing; and a power transmission member associated with said clipper housing, connected to said cam follower and constructed and arranged so that user manipulation of said bladeset angle control causes linear movement of said power transmission member and associated angular movement of said bladeset through rotation of said cam follower;

said power transmission member is connected at a free end to said bladeset, and is slidably mounted to said clipper housing for movement along said longitudinal axis; and said power transmission member has elongate slots that define a travel distance of said bladeset from a first position to a second position.

15. A hair clipper with blade angle adjustment, comprising:

a clipper housing defining a longitudinal axis and a cutting end;

a clipper bladeset operationally connected to said cutting end and including a stationary blade and a moving blade, the moving blade configured for reciprocating laterally relative to said stationary blade;

a cam follower connected to said bladeset and associated with said clipper housing for rotation about a rotation axis relative to said clipper housing;

a bladeset angle control associated with said clipper housing; and a power transmission member associated with said clipper housing, connected to said cam follower and constructed and arranged so that user manipulation of said bladeset angle control causes linear movement of said power transmission member and associated angular movement of said bladeset through rotation of said cam follower;

said power transmission member has a plurality of indexed positions disposed along said longitudinal axis; and wherein said indexed positions are defined by engagement of said power transmission member to said clipper housing using a plurality of linearly spaced lugs and openings.

16. The hair clipper of claim 15, wherein said lugs depend from an underside of an upper portion of said clipper housing, and said openings are located on said power transmission member.

17. The hair clipper of claim 15, wherein said bladeset angle control is associated with an upper portion of said clipper housing, is movable along said longitudinal axis as well as transverse to said axis and is connected to said power transmission member for common movement, so that linear movement of said bladeset angle control causes movement of said power transmission member, and movement of said bladeset angle control transverse to said clipper housing causes disengagement of said openings from said lugs, unlocking the selected angular position of said bladeset.

* * * * *